US009186893B2

(12) United States Patent
North et al.

(10) Patent No.: US 9,186,893 B2
(45) **Date of Patent: *Nov. 17, 2015**

(54) INKJET NOZZLE DEVICE CONFIGURED FOR VENTING GAS BUBBLES

(71) Applicant: MEMJET TECHNOLOGY LTD., Dublin (IE)

(72) Inventors: Angus John North, North Ryde (AU); Samuel George Mallinson, North Ryde (AU); Jennifer Mia Fishburn, North Ryde (AU)

(73) Assignee: Memjet Technology Ltd. (IE)

( * ) Notice: Subject to any disclaimer, the term of this patent is extended or adjusted under 35 U.S.C. 154(b) by 0 days.

This patent is subject to a terminal disclaimer.

(21) Appl. No.: 14/630,949

(22) Filed: Feb. 25, 2015

(65) Prior Publication Data

US 2015/0165768 A1 Jun. 18, 2015

Related U.S. Application Data

(63) Continuation of application No. 14/540,999, filed on Nov. 13, 2014, now Pat. No. 9,050,797, which is a continuation-in-part of application No. 14/310,353, filed on Jun. 20, 2014, now Pat. No. 9,044,945.

(60) Provisional application No. 61/859,889, filed on Jul. 30, 2013.

(51) Int. Cl.
*B41J 2/14* (2006.01)
*B41J 2/16* (2006.01)

(52) U.S. Cl.
CPC ..... *B41J 2/14088* (2013.01); *B41J 2/1404* (2013.01); *B41J 2/14016* (2013.01); *B41J 2/14032* (2013.01); *B41J 2/14129* (2013.01); *B41J 2002/14169* (2013.01); *B41J 2002/14475* (2013.01); *B41J 2202/07* (2013.01); *B41J 2202/18* (2013.01)

(58) Field of Classification Search
CPC ..... B41J 2/14; B41J 2/14016; B41J 2/14112; B41J 2/1412; B41J 2/14137; B41J 2/14088; B41J 2/14032
See application file for complete search history.

(56) References Cited

U.S. PATENT DOCUMENTS

| | | | | |
|---|---|---|---|---|
| 5,463,413 | A | 10/1995 | Ho et al. | |
| 6,491,377 | B1 | 12/2002 | Cleland et al. | |
| 7,464,465 | B2 | 12/2008 | Silverbrook | |
| 8,012,363 | B2 * | 9/2011 | McAvoy et al. | 216/27 |
| 2009/0096839 | A1 | 4/2009 | Olbrich et al. | |
| 2009/0267990 | A1 | 10/2009 | Lee et al. | |
| 2015/0070442 | A1 * | 3/2015 | North et al. | 347/63 |

OTHER PUBLICATIONS

International Search Report and Written Opinion for PCT/EP2014/063462 issued Aug. 26, 2014, 8 pages.

* cited by examiner

*Primary Examiner* — Juanita D Jackson
(74) *Attorney, Agent, or Firm* — Cooley LLP

(57) ABSTRACT

An inkjet nozzle device configured for venting a gas bubble during droplet ejection. The inkjet nozzle device includes: a firing chamber for containing ink, the firing chamber having a floor and a roof defining a nozzle aperture having a perimeter; and a heater element bonded to the floor of the firing chamber. The device is configured to satisfy the relationships A=swept volume/area of heater element=8 to 14 microns; and B=firing chamber volume/swept volume=2 to 6. The swept volume is defined as the volume of a shape defined by a projection from the perimeter of the nozzle aperture to the floor of the firing chamber, and includes a volume contained within the nozzle aperture.

13 Claims, 3 Drawing Sheets

INKJET NOZZLE DEVICE CONFIGURED FOR VENTING GAS BUBBLES

This application is a Continuation Application of Ser. No. 14/540,999 filed on Nov. 13, 2014 now U.S. Pat. No. 9,050,797, which is a Continuation-in-Part Application of U.S. application Ser. No. 14/310,353 filed on Jun. 20, 2014 now U.S. Pat. No. 9,044,945, the contents of which are incorporated herein by reference.

FIELD OF THE INVENTION

This invention relates to inkjet nozzle devices for inkjet printheads. It has been developed primarily to minimize cavitation damage to heater elements, improve thermal efficiency and increase printhead lifetimes.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary pagewidth printhead in combination with a feed mechanism which feeds print media past the printhead in a single pass. Memjet® printers therefore provide much higher printing speeds than conventional scanning inkjet printers.

An inkjet printhead is comprised of a plurality (typically thousands) of individual inkjet nozzle devices, each supplied with ink. Each inkjet nozzle device typically comprises a nozzle chamber having a nozzle aperture and an actuator for ejecting ink through the nozzle aperture. The design space for inkjet nozzle devices is vast and a plethora of different nozzle devices have been described in the patent literature, including different types of actuators and different device configurations.

One of the most important criteria in designing an inkjet nozzle device is achieving ink drop trajectories perpendicular to the nozzle plane. If each drop is ejected perpendicularly outward, the tail following the drop will not catch and deposit on the nozzle edge. A source of flooding and drop misdirection is thus avoided. Additionally, with perpendicular trajectories, the primary satellite formed by breakup of the drop tail can be made to land on top of the main drop on the page, hiding that satellite. Significant improvements in print quality can thus be obtained with perpendicular drop trajectories.

Memjet® inkjet printers are thermal devices, comprising heater elements which superheat ink to generate vapor bubbles. The expansion of these bubbles forces ink drops through the nozzle apertures. To ensure perpendicular trajectories for these drops, the bubbles must expand symmetrically. This requires symmetry in the design of the nozzle device.

Perfect fluidic symmetry around the heater element is not possible unless the heater element is suspended directly over the inlet to the nozzle chamber Inkjet nozzle devices having this arrangement are described in, for example, U.S. Pat. No. 6,755,509, and a printhead comprising such a device is shown in U.S. Pat. No. 7,441,865 (see, for example, FIG. 21B), the contents of which are herein incorporated by reference. However, devices having a heater element suspended over the chamber inlet require relatively complex fabrication methods and are less robust than devices having bonded heater elements. Furthermore, these devices suffer from a relatively high rate of backflow through the chamber inlet during ink ejection (resulting in inefficiencies), as well as potential printhead face flooding during chamber refilling by virtue of the alignment of the inlet and the nozzle aperture.

U.S. Pat. No. 7,857,428 describes an inkjet printhead comprising a row of nozzle chambers, each nozzle chamber having a sidewall entrance which is supplied with ink from a common ink supply channel extending parallel with the row of nozzle chambers. The ink supply channel is supplied with ink via a plurality of inlets defined in a floor of the channel. The entrance to each nozzle chamber may comprise a filter structure (e.g. a pillar) for filtering air bubbles or particulates entrained in the ink. The arrangement described in U.S. Pat. No. 7,857,428 provides redundancy in the supply of ink to the nozzle chambers, because all nozzle chambers in the same row (or pair of rows) are supplied with ink from the common ink supply channel extending parallel therewith. However, the arrangement described in U.S. Pat. No. 7,857,428 suffers from the disadvantages of relatively slow chamber refill rates and fluidic crosstalk between nearby nozzle chambers.

In addition, the arrangement described in U.S. Pat. No. 7,857,428 inevitably introduces a degree of asymmetry into droplet ejection compared to the arrangement described in U.S. Pat. No. 6,755,509. Since the heater element is laterally bounded by the chamber sidewalls except for the chamber entrance, the bubble generated by the heater element is distorted by this asymmetry. In other words, some of the impulse generated by the bubble tends to force some ink back through the chamber entrance as well as through the nozzle aperture. This results in skewed droplet ejection trajectories as well as a reduction in efficiency.

One measure for addressing the asymmetry caused by a sidewall chamber entrance is to lengthen and/or narrow the chamber entrance to increase its fluidic resistance to backflow. However, this measure is not viable in high-speed printers, because it inevitably reduces chamber refill rates due to the increased flow resistance. An alternative measure which compensates for the asymmetry caused by a sidewall chamber entrance is to offset the heater element from the nozzle aperture, as described in U.S. Pat. No. 7,780,271 (the contents of which is incorporated herein by reference).

It would be desirable to provide an inkjet nozzle device, which has a high degree of symmetry so as to minimize the extent of any compensatory measures required for correcting droplet ejection trajectories. It would further be desirable to provide an inkjet nozzle device having a high chamber refill rate, which is suitable for use in high-speed printing. It would further be desirable to provide an inkjet printhead having minimal fluidic crosstalk between nearby nozzle devices.

Furthermore, the high density of nozzle devices in a typical pagewidth printhead poses a thermal management problem: the ejection energy per drop ejected must be low enough to operate in so-called 'self-cooling' mode—that is, the chip temperature equilibrates to a steady state temperature well below the boiling point of the ink via removal of heat by ejected ink droplets.

Conventional inkjet nozzle devices comprise resistive heater elements coated with a number of relatively thick protective layers. These protective layers are necessary to protect the heater element from the harsh environment inside inkjet nozzle chambers. Typically, heater elements are coated with a passivation layer (e.g. silicon dioxide) to protect the heater element from corrosion and a cavitation layer (e.g. tantalum) to protect the heater element from mechanical cavitation forces experienced when a bubble collapses onto the heater element. U.S. Pat. No. 6,739,619 describes a conventional inkjet nozzle device having passivation and cavitation layers.

However, multiple passivation and cavitation layers are incompatible with low-energy 'self-cooling' inkjet nozzle devices. The relatively thick protective layers absorb too much energy and require drive energies which are too high for efficient self-cooling operation.

U.S. Pat. No. 6,113,221 describes an inkjet nozzle device, which vents gas bubbles through nozzle apertures during droplet ejection. By venting gas bubbles, instead of the gas bubbles collapsing onto the heater element, the damaging effects of cavitation forces can be avoided. Consequently, heater elements without cavitation layer(s) may be employed, which improves thermal efficiency. However, the inkjet nozzle devices described in U.S. Pat. No. 6,113,221 are configured to evacuate the entire nozzle chamber of ink during droplet ejection such that the volume of ejected droplets is substantially equal to the volume of the nozzle chamber. This places constraints on nozzle chamber designs for a target drop ejection volume.

It would be desirable to provide inkjet nozzle devices which vent gas bubbles, whilst allowing more flexible design criteria than the venting devices described in the prior art.

SUMMARY OF THE INVENTION

In a first aspect, there is provided an inkjet nozzle device comprising a main chamber having a floor, a roof and a perimeter wall extending between the floor and the roof, the main chamber comprising:

- a firing chamber having a nozzle aperture defined in the roof and an actuator for ejection of ink through the nozzle aperture;
- an antechamber for supplying ink to the firing chamber, the antechamber having a main chamber inlet defined in the floor; and
- a baffle structure partitioning the main chamber to define the firing chamber and the antechamber, the baffle structure extending between the floor and the roof, wherein the firing chamber and the antechamber have a common plane of symmetry.

Inkjet nozzle devices according to the present invention have a high degree of symmetry, which, as foreshadowed above, is essential for minimizing skewed droplet ejection trajectories. The high degree of symmetry is provided, firstly, by alignment of the nozzle aperture, the actuator, the baffle structure and the main chamber inlet along the common plane of symmetry to give perfect mirror symmetry about this axis (nominally the y-axis of the device). Hence, there is negligible skewing of ejected droplets along the x-axis.

Secondly, the baffle structure and an end portion of the perimeter wall are positioned to constrain bubble expansion equally along the y-axis during droplet ejection. Therefore, the positioning of the baffle structure effectively provides a high degree of mirror symmetry about an orthogonal x-axis of the firing chamber. Any skewing of droplet trajectories resulting from backflow through the baffle structure during droplet ejection will either be so small as to not require correction; or will require only small y-offset of the nozzle aperture, as described in U.S. Pat. No. 7,780,271, for correction to non-skewed ejection trajectories. (Whether or not a small y-offset correction is required may depend on factors, such as droplet volume, droplet ejection velocity, ink type, print quality requirements etc). From the foregoing, it will be appreciated that the inkjet nozzle device of the present invention has the advantages of excellent droplet ejection trajectories and, excellent efficiency (in terms of energy transfer from the bubble impulse into droplet ejection).

A further advantage of the inkjet nozzle device according to the present invention is a relatively high chamber refill rate compared to the devices described in U.S. Pat. No. 7,857,428. Since the antechamber receives ink via the floor inlet, which is typically connected to a much wider ink supply channel at the backside of the chip, each nozzle device effectively has direct access to a bulk ink supply. By contrast, in the arrangement described in U.S. Pat. No. 7,857,428, each nozzle chamber receives ink from the relatively narrow ink supply channel defined in the MEMS layer, which can become starved of ink in certain circumstances (e.g. full bleed printing or very high-speed printing). Starvation of the ink supply channel in the MEMS layer leads to poor chamber refill rates, a consequent reduction in print quality and accelerated actuator failure caused by actuators firing with empty or partially-empty nozzle chambers.

A further advantage of the present invention is that each nozzle device is effectively fluidically isolated from nearby devices by virtue of the perimeter wall of the main chamber. The perimeter wall is typically a solid, continuous wall enclosing the main chamber and is absent any interruptions or openings. Hence, with only a floor inlet into the antechamber, there is a tortuous fluidic path between nearby devices. This, in combination with the advantageous reduction in backflow by virtue of the device geometry described above, minimizes the possibility of any fluidic crosstalk between nearby devices. By contrast, the arrangement of nozzle devices described in U.S. Pat. No. 7,857,428 suffers from fluidic crosstalk via the sidewall chamber entrances and the adjoining MEMS ink supply channel.

These and other advantages of the inkjet nozzle device according to the present invention will be readily apparent from the detailed description below.

Preferably, the baffle structure comprises a single baffle wall. Preferably, the baffle wall has a pair of side edges such that a gap extends between each side edge and the perimeter wall to define a pair of firing chamber entrances flanking the baffle wall, the firing chamber entrances being disposed symmetrically about the common plane of symmetry.

The baffle wall advantageously mirrors, as far as possible, an opposite end wall of the firing chamber. Hence, the baffle wall and the opposite end wall provide a similar reaction force to the bubble impulse during droplet ejection, notwithstanding the firing chamber entrances flanking the baffle wall.

Preferably, the baffle wall is wider than the heater element. The width dimension is defined along the nominal x-axis of the main chamber. Preferably, the baffle wall occupies at least 30%, at least 40% or at least 50% of the width of the main chamber. Typically, the baffle wall occupies about half the width of the main chamber, with the firing chamber entrances flanking the baffle wall on either side thereof The baffle wall usually has a width dimension (along the x-axis), which is greater than a thickness dimension (along the y-axis). Typically, the width of the baffle wall is at least two times greater or at least three time greater than the thickness of the baffle wall.

Preferably, the nozzle aperture is elongate having a longitudinal axis aligned with the plane of symmetry. Preferably, the nozzle aperture is elliptical having a major axis aligned with the plane of symmetry.

In a preferred embodiment, the actuator comprises a heater element. In general, the present invention has been described in connection with a heater element actuator, in accordance with this preferred embodiment. However, it will be appreciated that the advantages of the present invention may be realized with other types of actuator, such as a piezo actuator as is well known in the art or a thermal bend actuator, as described in U.S. Pat. No. 7,819,503, the contents of which are herein incorporated by reference. In particular, symmetric constraint of a pressure wave in the firing chamber using the chamber geometry described herein may be advantageously implemented with other types of actuator.

The actuator may be bonded to the floor of the firing chamber, bonded to the roof of the firing chamber or suspended in the firing chamber. Preferably, the actuator comprises a resistive heater element bonded to the floor of the chamber.

Preferably, the heater element is elongate having a longitudinal axis aligned with the plane of symmetry. Preferably, the heater element is rectangular.

In one embodiment, a centroid of the nozzle aperture is aligned with a centroid of the heater element. However, in an alternative embodiment, a centroid of the nozzle aperture may be offset from a centroid of heater element along the longitudinal axis of the heater element. This y-offset may be used to correct for any residual asymmetry about the x-axis of the firing chamber.

Preferably, the heater element extends longitudinally from the baffle structure to the perimeter wall. Advantageously, a bubble propagating along the length of the heater element is constrained substantially equally by the perimeter wall and the baffle structure, and therefore expands symmetrically.

Preferably, the perimeter wall and baffle wall are staked over respective electrodes for the heater element.

Preferably, the perimeter wall and the baffle structure are comprised of a same material, typically by virtue of being co-deposited during fabrication of the device. The perimeter wall and baffle structure may be defined via an additive MEMS process, in which the material is deposited into openings defined in a sacrificial scaffold (see, for example, the additive MEMS fabrication process described in U.S. Pat. No. 7,857,428, the contents of which are herein incorporated by reference). Alternatively, the perimeter wall and baffle structure may be defined via a subtractive MEMS process, in which the material is deposited as a blanket layer and then etched to define the perimeter wall and baffle structure (see, for example, the subtractive MEMS fabrication process described in U.S. Pat. No. 7,819,503, the contents of which are herein incorporated by reference). For ease of fabrication, excellent roof planarity and robustness, and greater control of chamber height, the perimeter wall and baffle structure are preferably defined by a subtractive process similar to the process described in connection with FIGS. 3 to 5 of U.S. Pat. No. 7,819,503.

The perimeter wall and the baffle structure may be comprised of any suitable material, including polymers (e.g. epoxy-based photoresists, such as SU-8) and ceramics. Preferably, the perimeter wall and baffle structure are comprised of a material selected from the group consisting of: silicon oxide, silicon nitride and combinations thereof.

Likewise, the roof may be comprised of any suitable material, including the polymers and ceramics. The roof may be comprised of a same material as the perimeter wall and baffle structure, or a different material. Typically, a nozzle plate spans across a plurality of nozzle devices in a printhead to define the roofs of each nozzle device. The nozzle plate may be uncoated or coated with a hydrophobic coating, such as a polymer coating, using a suitable deposition process (see, for example, the nozzle plate coating process described in U.S. Pat. No. 8,012,363, the contents of which are herein incorporated by reference).

Preferably, the main chamber is generally rectangular in plan view. Preferably, the perimeter wall comprises a pair of longer sidewalls parallel with the plane of symmetry and a pair of shorter sidewalls perpendicular to the plane of symmetry.

Preferably, a first shorter sidewall defines an end wall of the firing chamber and a second shorter sidewall defines an end wall of the antechamber.

The firing chamber and antechamber may have any suitable relative volumes. The firing chamber may have a larger volume than the antechamber, a smaller volume than the antechamber or a same volume as the antechamber. Preferably, the firing chamber has a larger volume than the antechamber.

The present invention further provides an inkjet printhead or a printhead integrated circuit comprising a plurality of inkjet nozzle devices as described above.

Preferably, the printhead comprises a plurality of ink supply channels extending longitudinally along a backside thereof, wherein at least one row of main chamber inlets at a frontside of the printhead meets with a respective one of the ink supply channels. Preferably, each ink supply channel has a width dimension of at least 50 microns or at least 70 microns.

Preferably, each ink supply channel is at least two times, at least three times or at least four times wider than the main chamber inlets.

In a second aspect, there is provided an inkjet nozzle device configured for venting a gas bubble during droplet ejection, the inkjet nozzle device comprising:

a firing chamber for containing ink, the firing chamber having a floor and a roof defining an elongate nozzle aperture having a perimeter; and an elongate heater element bonded to the floor of the firing chamber, the heater element and nozzle aperture having aligned longitudinal axes, wherein the device is configured to satisfy the relationships A and B:

$$A = \text{swept volume/area of heater element} = 8 \text{ to } 14 \text{ microns}$$

$$B = \text{firing chamber volume/swept volume} = 2 \text{ to } 6$$

wherein the swept volume is defined as the volume of a shape defined by a projection from the perimeter of the nozzle aperture to the floor of the firing chamber, the swept volume including a volume contained within the nozzle aperture.

The above-described configuration of the firing chamber advantageously achieves bubble-venting through the nozzle aperture with each droplet ejection, thereby minimizing cavitation damage to the heater element.

Preferably A is from 9 to 13 microns, preferably from 10 to 12 microns, or preferably about 11 microns.

Preferably A is from 3 to 5 microns.

It will be appreciated that preferred aspects of the first aspect are equally applicable to the second aspect. For example, in a preferred embodiment of the second aspect, the inkjet nozzle device comprises a main chamber having the floor, the roof and a perimeter wall extending between the floor and the roof, the main chamber comprising:

the firing chamber;

an antechamber for supplying ink to the firing chamber, the antechamber having a main chamber inlet defined in the floor; and a baffle wall partitioning the main chamber to define the firing chamber and the antechamber, the baffle wall extending between the floor and the roof, wherein the firing chamber and the antechamber have a common plane of symmetry.

Preferably, the device is configured to eject ink droplets having a volume of from 75% to 100% of the swept volume, or preferably from 80% to 100%, or preferably from 85% to 100%, or preferably from 90% to 100% of the swept volume.

Preferably, the nozzle aperture is elliptical and the shape is an elliptic cylinder.

Preferably, the heater element extends beyond the longitudinal axis of the nozzle aperture.

Preferably, the heater element extends substantially between first and second walls of the firing chamber.

Preferably, a centroid of the heater element is equidistant from the first and second walls.

Preferably, the first wall is an end wall of the firing chamber and the second wall is a baffle wall, and wherein a pair of chamber inlets are defined on either side of the baffle wall.

Preferably, the roof has a thickness in the range of 1 to 5 microns.

Preferably, the firing chamber has a height in the range of 5 to 20 microns, or preferably in the range of 5 to 15 microns.

Preferably, the firing chamber has a volume in the range of 4 to 15 pL, or preferably 5 to 11 pL.

Preferably, the swept volume is in the range of 1 to 5 pL or preferably 1 to 3 pL.

As used herein, the term "ink" refers to any ejectable fluid and includes, for example, conventional colored inks, UV inks, IR inks, fluids suitable for 3D printing, biological fluids etc.

BRIEF DESCRIPTION OF THE DRAWINGS

Embodiments of the present invention will now be described by way of example only with reference to the accompanying drawings, in which.

DETAILED DESCRIPTION OF THE INVENTION

Device Geometry

Figure 1:
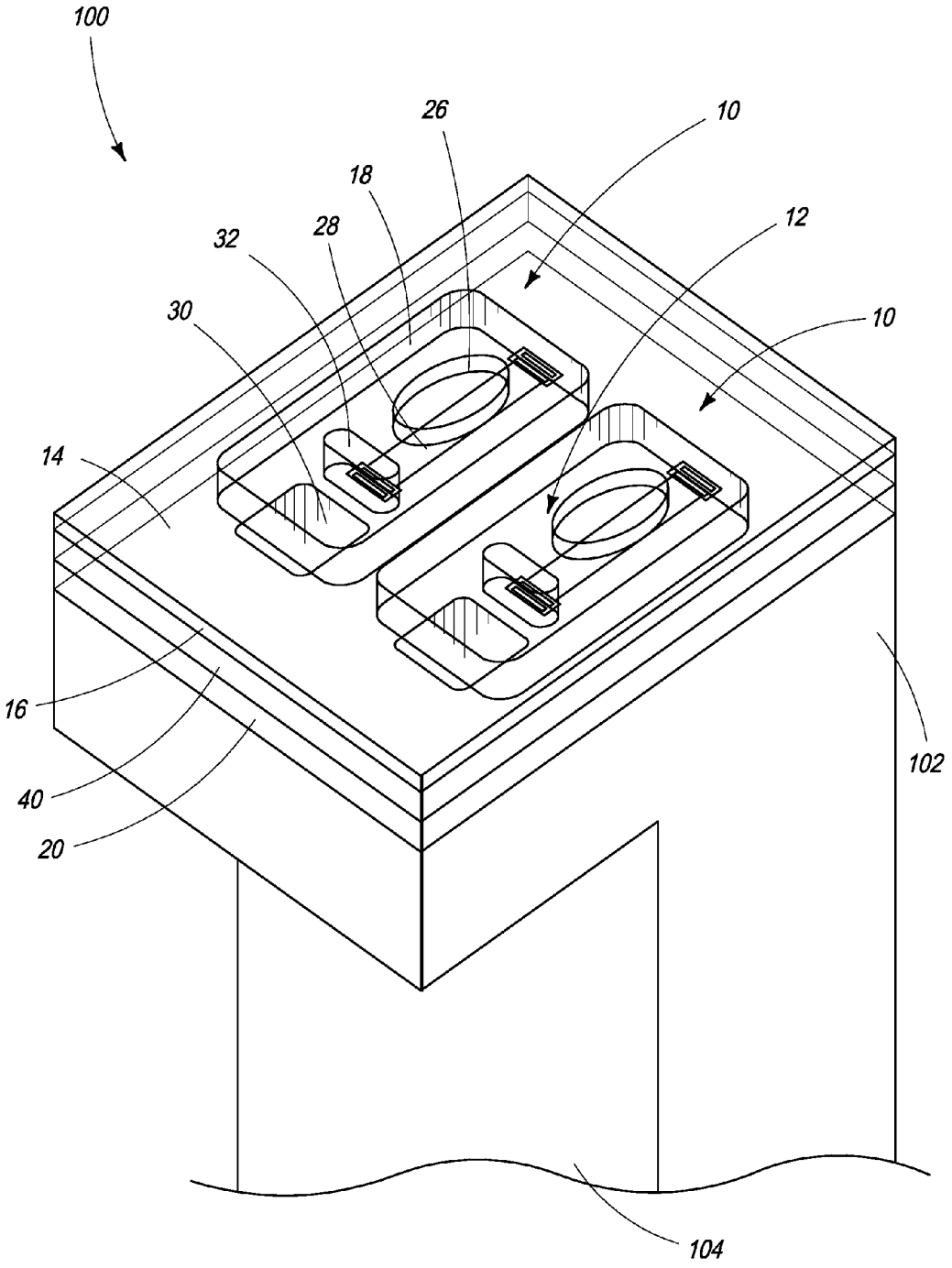
FIG. 1 is a cutaway perspective view of part of a printhead according to the present invention.
Figure 2:
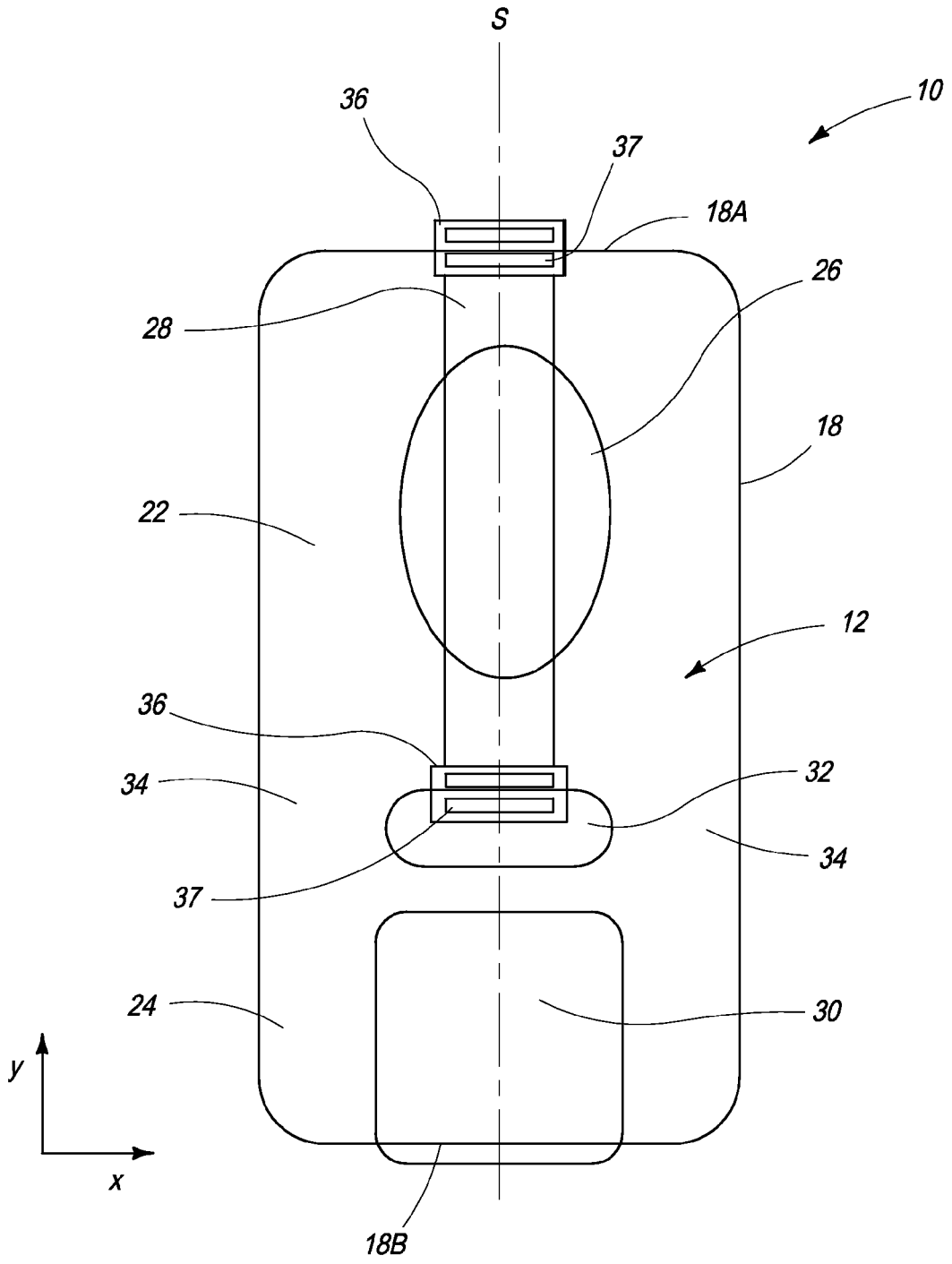
FIG. 2 is a plan view of an inkjet nozzle device according to the present invention.
Figure 3:
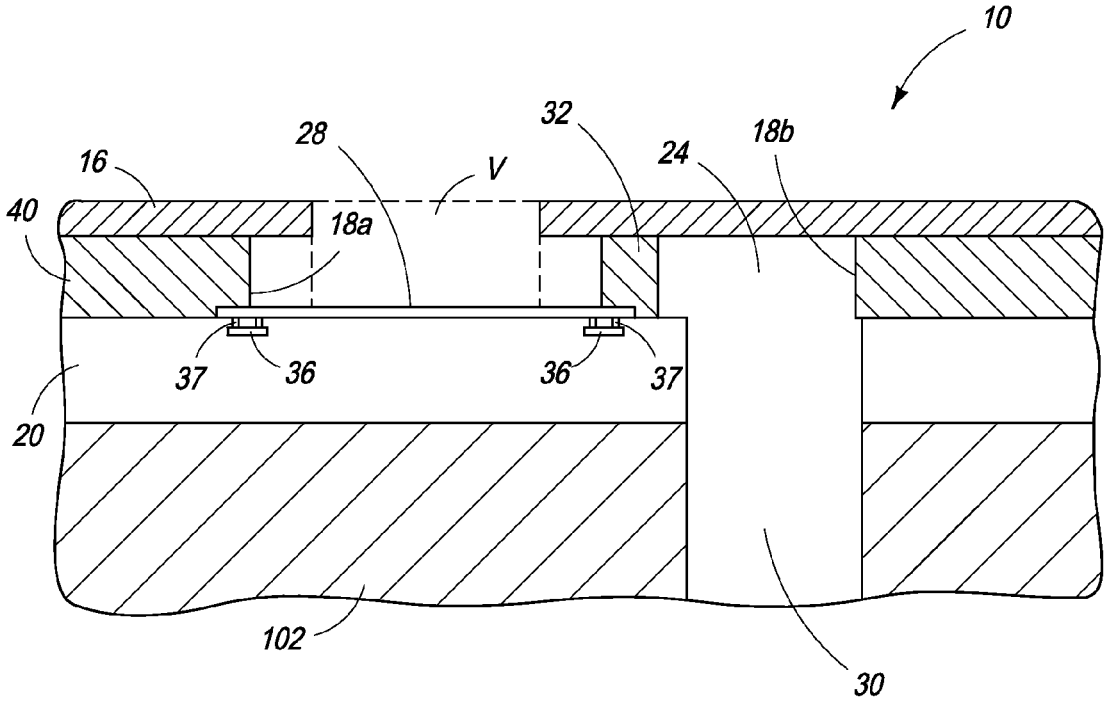
FIG. 3 is a sectional side view of one of the inkjet nozzle devices shown in FIG. 1.

Referring to FIGS. 1 to 3, there is shown an inkjet nozzle device 10 according to the present invention. The inkjet nozzle device comprises a main chamber 12 having a floor 14, a roof 16 and a perimeter wall 18 extending between the floor and the roof. Typically, the floor is defined by a passivation layer covering a CMOS layer 20 containing drive circuitry for each actuator of the printhead. FIG. 1 shows the CMOS layer 20, which may comprise a plurality of metal layers interspersed with interlayer dielectric (ILD) layers.

In FIG. 1 the roof 16 is shown as a transparent layer so as to reveal details of each nozzle device 10. Typically, the roof 16 is comprised of a material, such as silicon dioxide or silicon nitride.

Referring now to FIG. 2, the main chamber 12 of the nozzle device 10 comprises a firing chamber 22 and an antechamber 24. The firing chamber 22 comprises a nozzle aperture 26 defined in the roof 16 and an actuator in the form of a resistive heater element 28 bonded to the floor 14. The antechamber 24 comprises a main chamber inlet 30 ("floor inlet 30") defined in the floor 14.

The main chamber inlet 30 meets and partially overlaps with an end wall 18B of the antechamber 24. This arrangement optimizes the capillarity of the antechamber 24, thereby encouraging priming and optimizing chamber refill rates.

A baffle wall 32 partitions the main chamber 12 to define the firing chamber 22 and the antechamber 24. The baffle wall 32 extends between the floor 14 and the roof 16. As shown most clearly in FIG. 3, the side edges of the baffle wall 32 are typically rounded, so as to minimize the risk of roof cracking (Sharp angular corners in the baffle wall 32 tend to concentrate stress in the roof 16 and increase the risk of cracking).

The nozzle device 10 has a plane of symmetry extending along a nominal y-axis of the main chamber 12. The plane of symmetry is indicated by the broken line S in FIG. 2 and bisects the nozzle aperture 26, the heater element 28, the baffle wall 32 and the main chamber inlet 30.

The antechamber 24 fluidically communicates with the firing chamber 22 via a pair of firing chamber entrances 34 which flank the baffle wall 32 on either side thereof. Each firing chamber entrance 34 is defined by a gap extending between a respective side edge of the baffle wall 32 and the perimeter wall 18. Typically, the baffle wall 32 occupies about half the width of the main chamber 12 along the x-axis, although it will be appreciated that the width of the baffle wall may vary based on a balance between optimal refill rates and optimal symmetry in the firing chamber 22.

The nozzle aperture 26 is elongate and takes the form of an ellipse having a major axis aligned with the plane of symmetry S. The heater element 28 takes the form of an elongate bar having a central longitudinal axis aligned with the plane of symmetry S. Hence, the heater element 28 and elliptical nozzle aperture 26 are aligned with each other along their y-axes.

As shown in FIG. 2, the centroid of the nozzle aperture 26 is aligned with the centroid of the heater element 28. However, it will be appreciated that the centroid of the nozzle aperture 26 may be slightly offset from the centroid of the heater element 28 with respect to the longitudinal axis of the heater element (y-axis). Offsetting the nozzle aperture 26 from the heater element 28 along the y-axis may be used to compensate for the small degree of asymmetry about the x-axis of the firing chamber 22. Nevertheless, where offsetting is employed, the extent of offsetting will typically be relatively small (e.g. less than 1 micron).

The heater element 28 extends between an end wall 18A of the firing chamber 22 (defined by one side of the perimeter wall 18) and the baffle wall 32. The heater element 28 may extend an entire distance between the end wall 18A and the baffle wall 32, or it may extend substantially the entire distance (e.g. 90 to 99% of the entire distance) as shown in FIG. 2. If the heater element 28 does not extend an entire distance between the end wall 18A and the baffle wall 32, then a centroid of the heater element 28 still coincides with a midpoint between the end wall 18A and the baffle wall 32 in order to maintain a high degree of symmetry about the x-axis of firing chamber 22. In other words a gap between the end wall 18A and one end of the heater element 28 is equal to a gap between the baffle wall 32 and the opposite end of the heater element.

The heater element 28 is connected at each end thereof to respective electrodes 36 exposed through the floor 14 of the main chamber 12 by one or more vias 37. Typically, the electrodes 36 are defined by an upper metal layer of the CMOS layer 20. The heater element 28 may be comprised of, for example, titanium-aluminium alloy, titanium aluminium nitride etc. In one embodiment, the heater 28 may be coated with one or more protective layers, as known in the art. Suitable protective layers include, for example, silicon nitride, silicon oxide, tantalum etc.

The vias 27 may be filled with any suitable conductive material (e.g. copper, aluminium, tungsten etc.) to provide electrical connection between the heater element 28 and the electrodes 36. A suitable process for forming electrode connections from the heater element 28 to the electrodes 36 is described in U.S. Pat. No. 8,453,329, the contents of which are incorporated herein by reference.

In some embodiments, at least part of each electrode 36 is positioned directly beneath an end wall 18A and baffle wall 32 respectively. This arrangement advantageously improves the overall symmetry of the device 10, as well as minimizing the risk of the heater element 28 delaminating from the floor 14.

As shown most clearly in FIG. 1, the main chamber 12 is defined in a blanket layer of material 40 deposited onto the floor 14 by a suitable etching process (e.g. plasma etching, wet etching, photo etching etc.). The baffle wall 32 and the perimeter wall 18 are defined simultaneously by this etching process, which simplifies the overall MEMS fabrication process. Hence, the baffle wall 32 and perimeter wall 18 are comprised of the same material, which may be any suitable etchable ceramic or polymer material suitable for use in printheads. Typically, the material is silicon dioxide or silicon nitride.

Referring back to FIG. 2, it can be seen that the main chamber 12 is generally rectangular having two longer sides and two shorter sides. The two shorter sides define end walls 18A and 18B of the firing chamber 22 and the antechamber 24, respectively, while the two longer sides define contiguous sidewalls of the firing chamber and antechamber. Typically, the firing chamber 22 has a larger volume than the antechamber 24.

A printhead 100 may be comprised of a plurality of inkjet nozzle devices 10. The partial cutaway view of the printhead 100 in FIG. 1 shows only two inkjet nozzle devices 10 for clarity. The printhead 100 is defined by a silicon substrate 102 having the passivated CMOS layer 20 and a MEMS layer containing the inkjet nozzle devices 10. As shown in FIG. 1, each main chamber inlet 30 meets with an ink supply channel 104 defined in a backside of the printhead 100. The ink supply channel 104 is generally much wider than the main chamber inlets 30 and effectively a bulk supply of ink for hydrating each main chamber 12 in fluid communication therewith. Each ink supply channel 104 extends parallel with one or more rows of nozzle devices 10 disposed at a frontside of the printhead 100. Typically, each ink supply channel 104 supplies ink to a pair of nozzle rows (only one row shown in FIG. 1 for clarity), in accordance with the arrangement shown in FIG. 21B of U.S. Pat. No. 7,441,865.

The advantages of the nozzle device configuration shown in FIGS. 1 to 3 are realized during droplet ejection and subsequent chamber refilling. When the heater element 28 is actuated by a firing pulse from drive circuitry in the CMOS layer 20, ink in the vicinity of the heater element is rapidly superheated and vaporizes to form a bubble. As the bubble expands, it produces a force ("bubble impulse"), which pushes ink towards the nozzle aperture 26 resulting in droplet ejection. In the absence of the baffle wall 32, the bubble would expand asymmetrically as described in U.S. Pat. No. 7,780,271. Asymmetric bubble expansion occurs when one end of the expanding bubble is constrained by a reaction force (typically provided by one wall of the firing chamber) while the other end of the bubble is unconstrained. However, in the present invention, the baffle wall 32 provides a reaction force to the expanding bubble which is substantially equal to the reaction force provided by the end wall 18A of the firing chamber 22. Therefore, the bubble formed by the inkjet nozzle device 10 is constrained by two opposite walls in the firing chamber 22 and has excellent symmetry compared to the devices described in U.S. Pat. No. 7,780,271 and U.S. Pat. No. 7,857,428. Consequently, ejected ink droplets have minimal skew along both the x- and y-axes.

Moreover, any backflow is minimized because the firing chamber entrances 34 are positioned along the sidewalls of the main chamber 12. During bubble propagation, the majority of the bubble impulse is directed towards the nozzle aperture 26, such that only a relatively small vector component of the bubble impulse reaches the firing chamber entrances 34. Therefore, positioning the firing chamber entrances 34 along the flanks of the baffle wall 36 minimizes backflow during droplet ejection.

Whilst backflow is minimized by the inkjet nozzle device 10, it will be appreciated that backflow cannot be wholly eliminated in any inkjet nozzle device. Backflow can not only affect bubble symmetry and droplet trajectories, but also potentially results in fluidic crosstalk between nearby devices via a pressure wave associated with the backflow of ink. This pressure wave may cause nearby non-ejecting nozzles to flood ink onto the surface of the printhead, resulting in reduced print quality (e.g. by causing misdirection or variable drop size) and/or necessitating more frequent printhead maintenance interventions.

Referring to FIG. 1, fluidic crosstalk between the adjacent nozzle devices 10 is minimized, firstly, by virtue of the tortuous flow path between the devices. Any backflow of ink must flow down through one floor inlet 30, into the ink supply channel 104 and up through another nearby floor inlet 30. Secondly, the pressure wave from any backflow is dampened by the relatively large volume of the ink supply channel 104, which further minimizes the risk of crosstalk between nearby devices.

In a similar manner, fluidic crosstalk during refill of each chamber (which can cause negative pressure in neighboring nozzles and variable drop size) is also minimized.

On the other hand, the accessibility of each device 10 to the bulk ink supply of the ink supply channel 104 via a respective floor inlet 30 advantageously maximizes the refill rate of each main chamber 12. Ink is allowed to flow freely into the antechamber 24 from the ink supply channel 104 via the floor inlet 30, but the momentum of this ink is dampened by the roof and sidewalls of the antechamber 24, as well as the baffle wall 32. Therefore, the antechamber 24 has an important role in minimizing printhead face flooding during chamber refilling compared to, for example, the devices described in U.S. Pat. No. 7,441,865.

The critical refill rate of the firing chamber 22 may be controlled by adjusting the width of the baffle wall 32, thereby narrowing or widening the firing chamber entrances 34. Of course, there will be a trade-off between maximizing firing chamber refill rates versus minimizing backflow during droplet ejection. In this regard, it will be appreciated that the optimum width of the baffle wall 32 may be 'tuned', depending on parameters such as the viscosity and surface tension of ink, maximum ejection frequency, droplet volume etc. In practice, the optimum width of the baffle wall 32 for a particular printhead and ink may be determined empirically. The inkjet nozzle device 10 according to the present invention typically has chamber refill rate suitable for a droplet ejection frequency greater than 10 kHz or greater than 15 kHz, based on a 1.5 pL droplet volume.

Bubble Venting

The inkjet nozzle device 10 described above may be configured to eject ink droplets in a bubble venting mode. It has been found that by controlling certain critical parameters, the ejection mode of the inkjet nozzle device 10 may be controlled either to vent a gas bubble through the nozzle aperture with each ejection or to allow bubble collapse onto the heater element 28 with each ejection.

Bubble venting is generally considered to be advantageous, because it minimizes cavitation forces on the heater element 28 that would otherwise result from bubble collapse. Minimizing such cavitation forces obviates the requirement for additional cavitation protection layer(s), such as tantalum metal, on the heater element. Avoiding cavitation protection layers on the heater element improves thermal efficiency and potentially enables self-cooling operation of the device.

Approaches to bubble venting described in the prior art (e.g. U.S. Pat. No. 6,113,221) have focused on nozzle chamber geometries having generally a circular nozzle aperture and a square heater element bonded to a floor of the nozzle chamber. With radial bubble growth emanating from the square heater element, such prior art methods for bubble venting require evacuation of an entire nozzle chamber during each droplet ejection. Hence, the volume of each ejected ink droplet is substantially equal to the volume of the nozzle chamber.

This approach to bubble venting has certain disadvantages. For example, nozzle chamber volumes must conform to the desired volume of ejected ink droplets. If small droplet volumes (e.g. <2 pL) are required, this places demands on MEMS printhead fabrication processes which are required to produce correspondingly small nozzle chambers.

However, the elongate geometry of the firing chamber 22, as best shown in FIG. 2, enables bubble venting during droplet ejection without requiring evacuation of the entire volume of the firing chamber. It has been found that, provided the "swept volume", the area of the heater element and the firing chamber volume conform to certain parameters, then bubble venting can be achieved without evacuating the entire firing chamber 22 with each droplet ejection.

The "swept volume" V is shown in dotted outline in FIG. 3 and is defined as the volume of a shape defined by a projection from the perimeter of the nozzle aperture 26 to the floor 14 of the firing chamber 22, the swept volume including a volume contained within the nozzle aperture. In the case of the elliptical nozzle aperture 26 shown in FIG. 2, the shape of the swept volume is an elliptic cylinder, although other elongate non-circular nozzle shapes (e.g. rounded oblong, 'peanut'-shaped etc.) are equally possible. Some examples of elongate non-circular nozzle shapes are described in, for example, U.S. Pat. No. 8,267,501.

The "area of heater element" is defined as the total area of the heater element in the firing chamber which is available for heating ink. In preferred embodiments, and as shown iN FIG. 2, the area of the heater element includes portions which extend beyond an area bound by the swept volume.

The "firing chamber volume" is defined as the total volume of the firing chamber in which bubble nucleation and propagation occurs. The firing chamber volume, by definition, includes the entire swept volume, and the firing chamber necessarily contains the entire heater element. In the example shown in FIGS. 1 to 3, the firing chamber volume is defined by a shape bounded by: a surface of the baffle wall 32 facing the end wall 18A (and its projection to the perimeter sidewalls 18), the end wall 18A, an upper surface of the roof 16 and the floor 14.

Specifically, it has been found that, in order to achieve bubble venting, the inkjet nozzle device should have a geometry satisfying relationships A and B:

$A$=swept volume/area of heater element=8 to 14 microns $B$=firing chamber volume/swept volume=2 to 6

Table 1 shows various chamber configurations for the inkjet nozzle device described above in connection with FIGS. 1 to 3. Each of these chamber configurations produces bubble venting during droplet ejection. In each of Examples 1 to 3, the roof height above the heater was 8.7 microns, the roof had a thickness of 3 microns, and the firing chamber volume was 7660 $\mu m^3$ (7.66 pL).

TABLE 1

Chamber Configurations for Bubble Venting

| Example No. | Heater width, μm | Heater area, $(\mu m)^3$ | Nozzle area, $(\mu m)^2$ | Swept volume, $(\mu m)^3$ | A, μm | Ejected volume, $(\mu m)^3$ | Ejected volume/ swept volume | B |
|---|---|---|---|---|---|---|---|---|
| 1 | 6.8 | 197.2 | 183.8 | 2150.5 | 10.90 | 2000 | 0.93 | 3.56 |
| 2 | 8.2 | 237.8 | 220.6 | 2581.0 | 10.85 | 2400 | 0.93 | 2.96 |
| 3 | 5.1 | 147.9 | 137.9 | 1613.4 | 10.91 | 1500 | 0.93 | 4.75 |

When the behaviors of devices not satisfying relationships A and B were modelled, it was found that bubble venting did not occur, thereby demonstrating that these parameters are critical for determining the ejection mode of devices having aligned elongate nozzle apertures and heater elements.

From the foregoing, the skilled person will, of course, be readily able to configure other inkjet nozzle devices satisfying relationships A and B, which achieve bubble venting during ink ejection.

It will, of course, be appreciated that the present invention has been described by way of example only and that modifications of detail may be made within the scope of the invention, which is defined in the accompanying claims.

The invention claimed is:

1. An inkjet nozzle device configured for venting a gas bubble during droplet ejection, the inkjet nozzle device comprising:

a firing chamber for containing ink, the firing chamber having a floor and a roof defining a nozzle aperture having a perimeter; and a heater element bonded to the floor of the firing chamber, wherein the device is configured to satisfy the relationships A and B:

$A$=swept volume/area of heater element=8 to 14 microns $B$=firing chamber volume/swept volume=2 to 6 wherein the swept volume is defined as the volume of a shape defined by a projection from the perimeter of the nozzle aperture to the floor of the firing chamber, the swept volume including a volume contained within the nozzle aperture.

2. The inkjet nozzle device of claim 1, wherein the device is configured to eject ink droplets having a volume of from 75% to 100% of the swept volume.

3. The inkjet nozzle device of claim 1, wherein the nozzle aperture is elliptical and the shape is an elliptic cylinder.

4. The inkjet nozzle device of claim 1, wherein the heater element extends beyond opposite edges of the nozzle aperture.

5. The inkjet nozzle device of claim 1, wherein the heater element extends substantially between first and second walls of the firing chamber.

6. The inkjet nozzle device of claim 5, wherein a centroid of the heater element is equidistant from the first and second walls.

7. The inkjet nozzle device of claim 5, wherein the first wall is an end wall of the firing chamber and the second wall is a baffle wall, and wherein a pair of chamber inlets are defined on either side of the baffle wall.

8. The inkjet nozzle device of claim 7, wherein the baffle wall is wider than the heater element.

9. The inkjet nozzle device of claim 1, wherein the roof has a thickness in the range of 1 to 5 microns.

10. The inkjet nozzle device of claim 1, wherein the firing chamber has a height in the range of 5 to 20 microns.

11. The inkjet nozzle device of claim 1, wherein the firing chamber has a volume in the range of 4 to 15 pL.

12. The inkjet nozzle device of claim 1, wherein the swept volume is in the range of 1 to 5 pL.

13. The inkjet nozzle device of claim 1, wherein the heater element is absent a cavitation protection layer.

* * * * *